US006620080B1

(12) United States Patent
Gray

(10) Patent No.: US 6,620,080 B1
(45) Date of Patent: Sep. 16, 2003

(54) EXERCISE DEVICE

(75) Inventor: Gary W. Gray, Adrian, MI (US)

(73) Assignee: True Fitness Technology, Inc., O'Fallon, MO (US)

( * ) Notice: Subject to any disclaimer, the term of this patent is extended or adjusted under 35 U.S.C. 154(b) by 433 days.

(21) Appl. No.: 09/596,383

(22) Filed: Jun. 16, 2000

Related U.S. Application Data

(63) Continuation-in-part of application No. 09/174,306, filed on Oct. 16, 1998, now Pat. No. 6,077,202.
(60) Provisional application No. 60/062,577, filed on Oct. 17, 1997.

(51) Int. Cl.[7] ..... A63B 22/04
(52) U.S. Cl. ..... 482/52; 482/63
(58) Field of Search ..... 482/51–52, 57, 482/62, 63, 70, 71, 79, 92, 93, 148

(56) References Cited

U.S. PATENT DOCUMENTS

| | | | |
|---|---|---|---|
| 1,015,071 | A | 1/1912 | Reach |
| 2,068,578 | A | 1/1937 | Stronach |
| 2,544,106 | A | 3/1951 | Ray |
| 2,829,891 | A | 4/1958 | Ludwig |
| 3,475,020 | A | 10/1969 | Schauerte |
| 3,475,021 | A | 10/1969 | Ruegsegger |
| 3,485,495 | A | 12/1969 | Gibbs |
| 3,511,500 | A | 5/1970 | Dunn |
| 3,713,653 | A | 1/1973 | Romans |
| 3,756,595 | A | 9/1973 | Hague |
| 3,792,860 | A | 2/1974 | Selnes |
| 3,814,420 | A | 6/1974 | Encke |
| 3,833,215 | A | 9/1974 | Isdith |
| 4,340,214 | A | 7/1982 | Schutzer |
| 4,396,189 | A | 8/1983 | Jenkins |
| 4,509,742 | A | 4/1985 | Cones |
| 4,563,001 | A | 1/1986 | Terauds |
| 4,577,861 | A | 3/1986 | Bangerter et al. |
| 4,609,190 | A | 9/1986 | Brentham |
| 4,708,338 | A | 11/1987 | Potts |
| 4,739,984 | A | 4/1988 | Dranselka |
| 4,781,372 | A | 11/1988 | McCormack |
| 4,830,362 | A | 5/1989 | Bull |
| 4,900,012 | A | 2/1990 | Fu |
| 4,915,373 | A | 4/1990 | Walker |
| 4,934,688 | A | 6/1990 | Lo |

(List continued on next page.)

*Primary Examiner*—Nicholas D. Lucchesi
*Assistant Examiner*—Tam Nguyen
(74) *Attorney, Agent, or Firm*—Lewis, Rice & Fingersh, LC

(57) ABSTRACT

The exercise device of the present invention has a base having at least one frame member extending from the base. A rotatable drive shaft is mounted on the frame and a first one-way clutch and a second one-way clutch are mounted on the drive shaft. A means is provided for operatively connecting the drive shaft to an alternator whereby rotation of the drive shaft causes the alternator to provide resistance to the exercise device and to generate electricity. A pair of arms and a pair of levers are pivotally mounted on the base whereby movement of the arms causes a movement of the levers. A foot pad is positioned on each of the arms. The foot pads are disposed to move in an arcuate path towards and away from the side members of the base. A means is provided for operatively connecting one of the levers to the first one-way clutch and the other lever to the second one-way clutch. Movement of the arms towards the base causes the levers to rotate the first and second one-way clutches in a direction that causes the drive shaft to rotate which, in turn, causes the alternator to provide resistance to the exercise device and generate electricity. Movement of the arms away from the base rotates the levers in a direction that does not activate the first and second one-way clutches and does not cause the drive shaft to rotate.

16 Claims, 6 Drawing Sheets

U.S. PATENT DOCUMENTS

| | | | | | |
|---|---|---|---|---|---|
| 4,938,474 | A | | 7/1990 | Sweeney et al. | |
| 4,989,858 | A | | 2/1991 | Young et al. | |
| 5,100,129 | A | | 3/1992 | Porter et al. | |
| 5,178,596 | A | | 1/1993 | McIntire | |
| 5,209,711 | A | | 5/1993 | Scrima | |
| 5,221,242 | A | | 6/1993 | Weber et al. | |
| 5,222,928 | A | | 6/1993 | Yacullo | |
| 5,316,528 | A | | 5/1994 | Ziparo | |
| 5,316,530 | A | | 5/1994 | Romer | |
| 5,328,427 | A | | 7/1994 | Sleamaker | |
| 5,336,143 | A | * | 8/1994 | Wu | 482/52 |
| 5,352,185 | A | | 10/1994 | Blauth et al. | |
| 5,356,362 | A | | 10/1994 | Becker et al. | |
| 5,372,564 | A | | 12/1994 | Spirito | |
| 5,391,130 | A | | 2/1995 | Green et al. | |
| RE34,959 | E | * | 5/1995 | Potts | 482/52 |
| 5,441,472 | A | | 8/1995 | Johnston | |
| 5,487,711 | A | | 1/1996 | Little | |
| 5,499,956 | A | | 3/1996 | Habing et al. | |
| 5,499,958 | A | | 3/1996 | Hess | |
| 5,509,880 | A | | 4/1996 | Becker et al. | |
| 5,509,894 | A | | 4/1996 | Mason et al. | |
| 5,518,470 | A | | 5/1996 | Paiget et al. | |
| 5,520,598 | A | | 5/1996 | Little | |
| 5,527,247 | A | | 6/1996 | Archambault | |
| 5,540,637 | A | | 7/1996 | Rodgers, Jr. | |
| 5,665,033 | A | | 9/1997 | Palmer | |
| 5,807,210 | A | | 9/1998 | Devlin | |
| 5,961,423 | A | * | 10/1999 | Sellers | 482/57 |

* cited by examiner

EXERCISE DEVICE

RELATED APPLICATION

This is a continuation-in-part application of U.S. application Ser. No. 09/174,306 filed on Oct. 16, 1998, now U.S. Pat. No. 6,077,202 which issues on Jun. 20, 2000 which claims benefit of U.S. patent application Ser. No. 06/062,577 filed Oct. 17, 1997.

BACKGROUND OF THE INVENTION

A regimen of regular exercise is beneficial to the general physical well being of a person. Although outdoor exercise, e.g., walking or jogging is preferable, the vagaries of the weather and other factors often preclude adherence to a regular outdoor exercise program. To this end, numerous indoor exercise devices have been developed ranging from the familiar treadmills and stationary bicycles to complex, elaborate apparatus designed to simulate stair climbing or other body exercising functions. Many such complex devices are not only quite expensive, but due to their size are not readily portable or easily storable and moreover, require frequent maintenance.

It is therefore the principal object of this invention to provide a compact, reliable exercise and body toning apparatus, particularly for exercising and toning the lower body, which is both simple to use and usable by persons having a wide range of strength capabilities.

SUMMARY OF THE INVENTION

The exercise device of the present invention has a base having two side members and front member that extends between the side members. At least one frame member extends from the base. A rotatable drive shaft is mounted on the frame member and a first one-way clutch and a second one-way clutch are mounted on the drive shaft.

A means is provided for operatively connecting the drive shaft to an alternator whereby rotation of the drive shaft causes the alternator to generate electricity and to provide resistance to the exercise device. A pair of arms have a first end that is pivotally mounted on the base and a second end that extends from the base. A foot pad is positioned on the second end of each of the arms. The foot pads are disposed to move in an arcuate path towards and away from the side members of the base. The movement of the foot pads is in a direction that is substantially parallel to the front member of the base. A lever is operatively connected to each arm whereby movement of the arms causes a movement of the levers. A means is provided for operatively connecting one of the levers to the first one-way clutch and the other lever to the second one-way clutch. The movement of the arms towards the base causes the levers to rotate the first and second one-way clutches in a direction that causes the drive shaft to rotate which in turn causes the alternator to generate electricity. The alternator provides resistance to movement of the arms and the levers. Movement of the arms away from the base rotates the levers in a direction that does not activate the first and second one-way clutches and does not cause the drive shaft to rotate.

and

Figure 7:
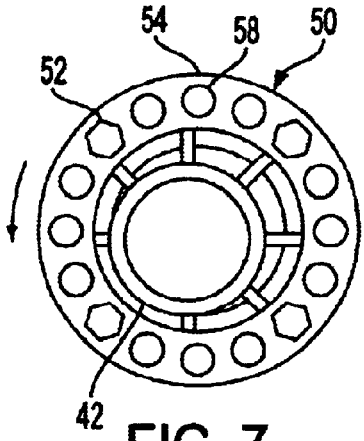

FIG. 7 is a front elevational view of an eccentric hub.

DETAILED DESCRIPTION OF THE PREFERRED EMBODIMENTS

The present invention is directed to an exercise device for providing movement to the lower extremities of a user. More particularly, the exercise device utilizes a side-to-side stepping motion for exercising the major muscle groups of the lower extremities. The features of the invention will be more clearly understood by referring to the accompanying drawings and the following specification.

The exercise device 5 has a base 7 and opposing side base members 9, a rear base member 10 and a front base member 11. The exercise device 5 has opposing vertical frame members 12 which extend from the ends of the side base members 9 which are spaced apart from the front base member 11 and which are adjacent the rear base member 10. A lower cross member 13 horizontally extends from one vertical frame member 12 to the opposing vertical frame member 12. An upper cross member 14 is in a parallel and spaced apart relationship to the lower cross member 13 and also horizontally extends from one vertical frame member 12 to the opposing vertical frame member 12. A pair of opposed vertical brace members 15 are in a spaced apart parallel relationship and extend from the lower horizontal cross member 13 to the upper horizontal cross member 14. A pair of angle braces 17 extend between the side base members 9 and the vertical frame members 12.

A handle 18 horizontally extends between the ends of the opposing vertical support members 12 that are spaced apart from the side members 9 of the base 7. A computer display 19 can be mounted on the handle 18 for entering and displaying such data as user's weight, program to be used, time elapsed and the like.

Figure 3:
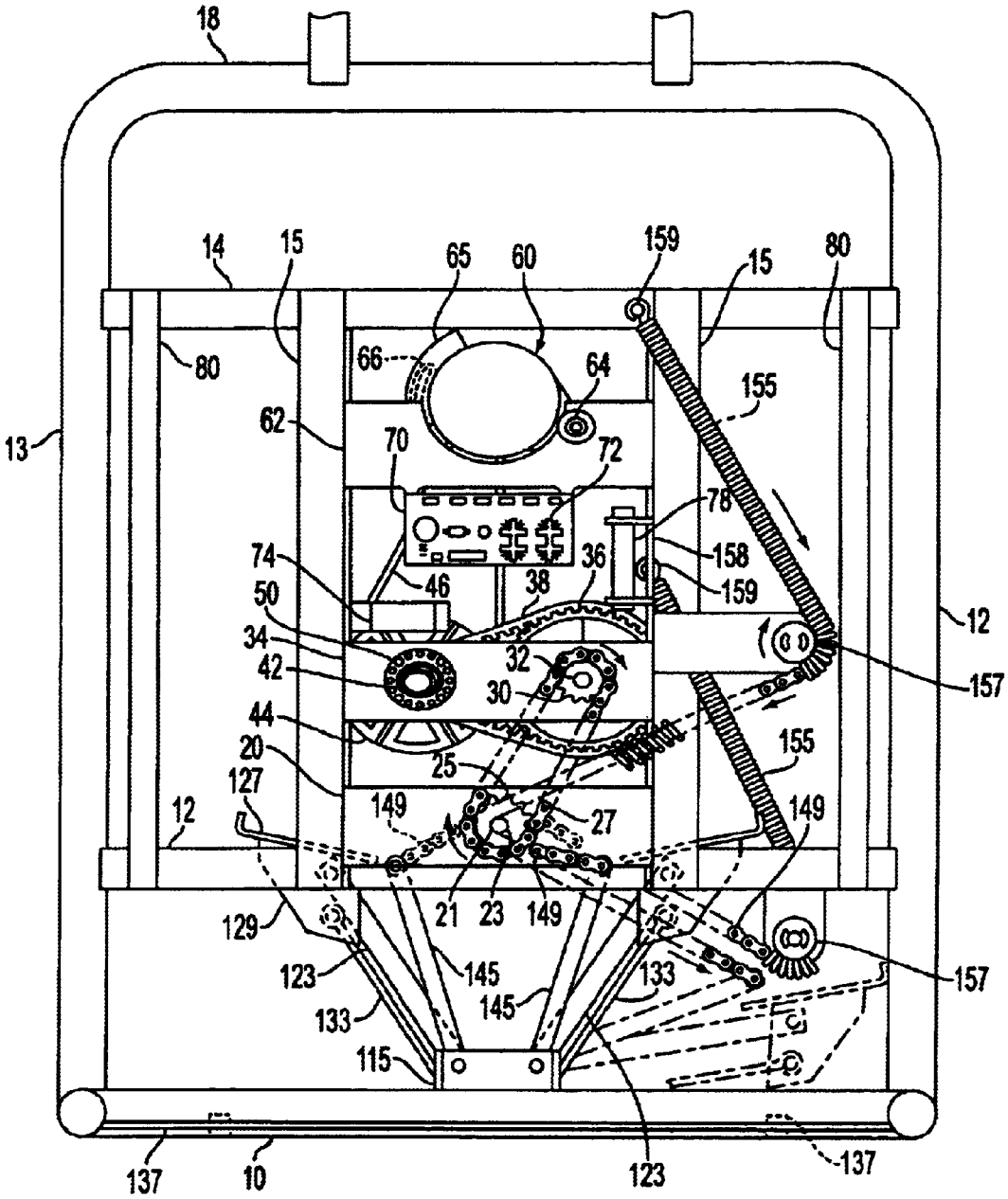
FIG. 3 is a partial back view, partially in phantom.
Figure 4:
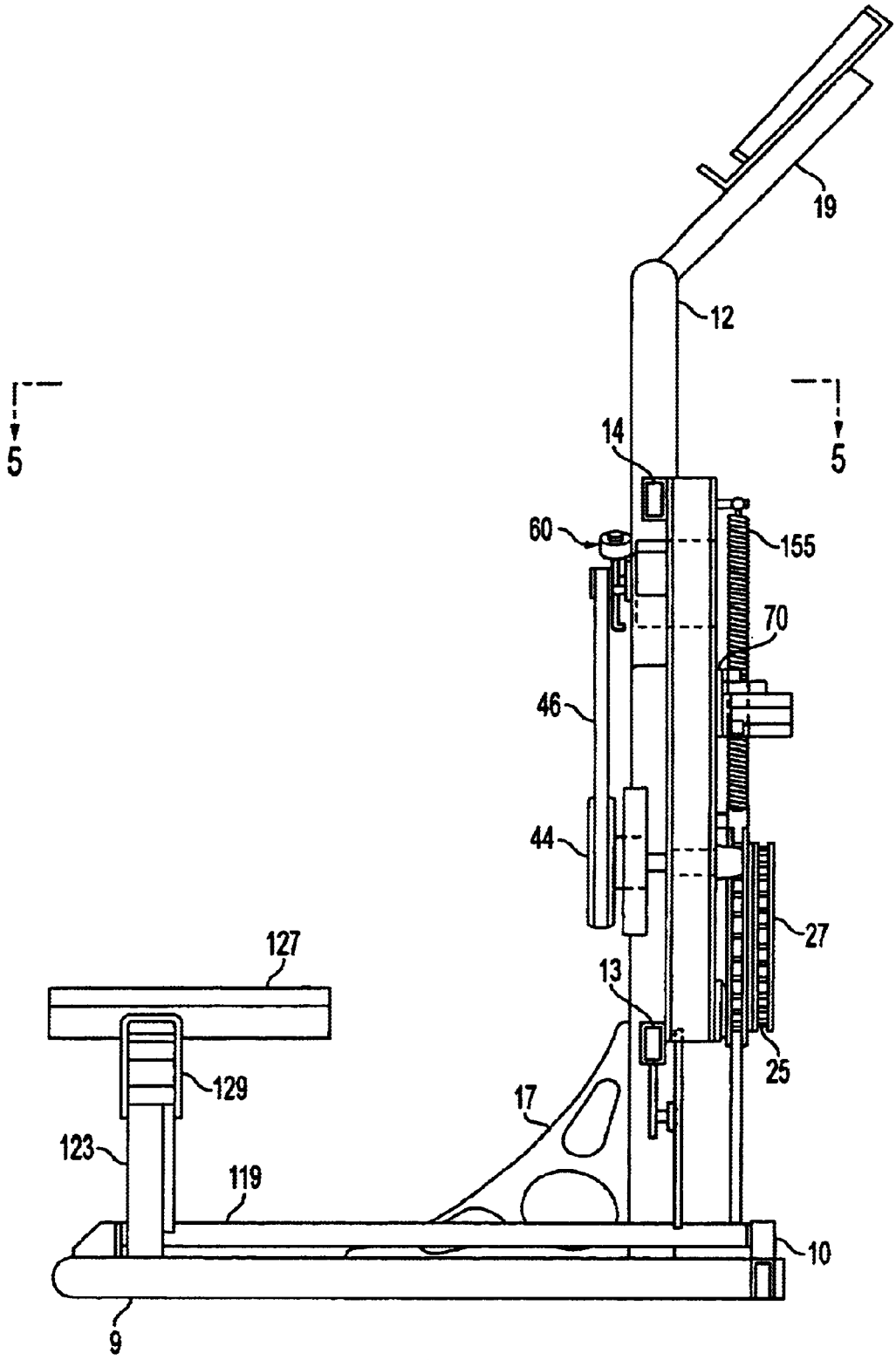
FIG. 4 is a side elevational view.
Figure 5:
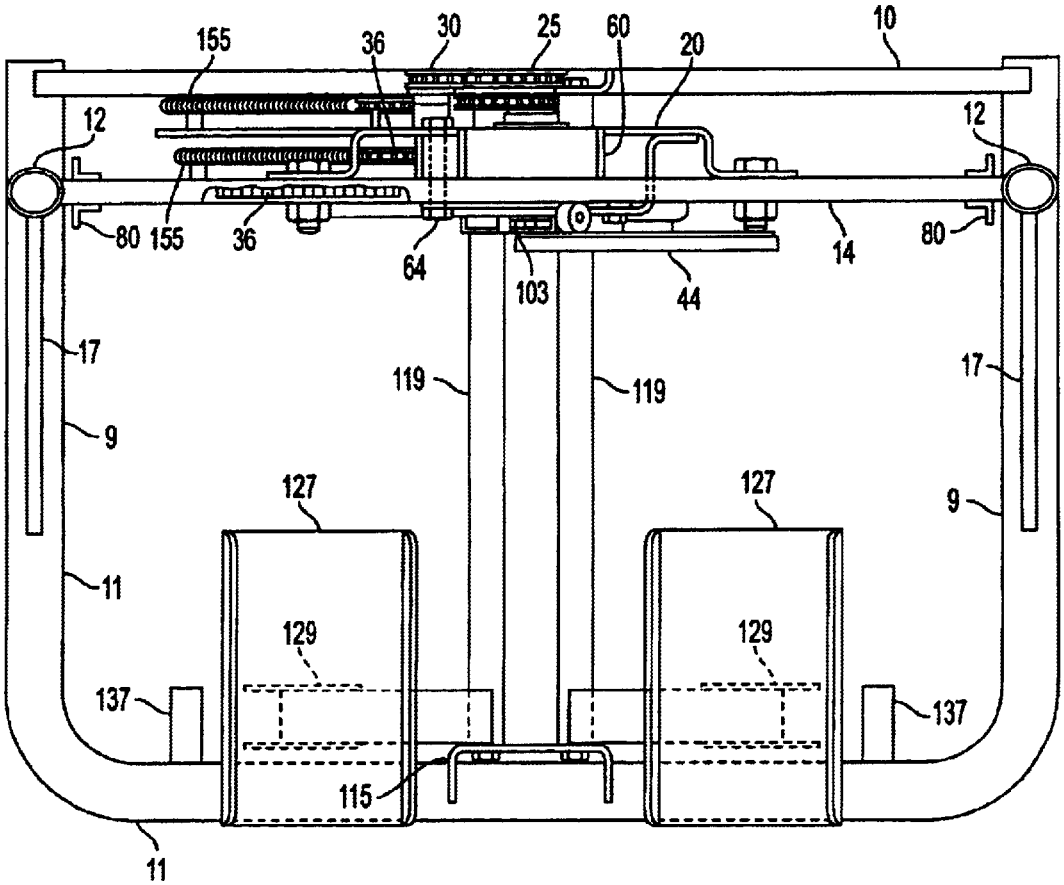
FIG. 5 is a partial cross-sectional view taken along line 5—5 in FIG. 4.

As best seen in FIG. 3, a drive shaft 21 is rotatably mounted in a aperture 23 on a mounting bracket 20 that extends between the vertical brace member 13 at a point substantially adjacent the lower cross member 15. A sprocket 25 is secured to the drive shaft 21 on the back side of the mounting bracket 20 that is adjacent the rear base member 10. A drive means 27 such as a chain or other engaging means operatively connects the sprocket 25 on the drive shaft 21 with a sprocket 30, as will be further explained in detail below.

Figure 6:
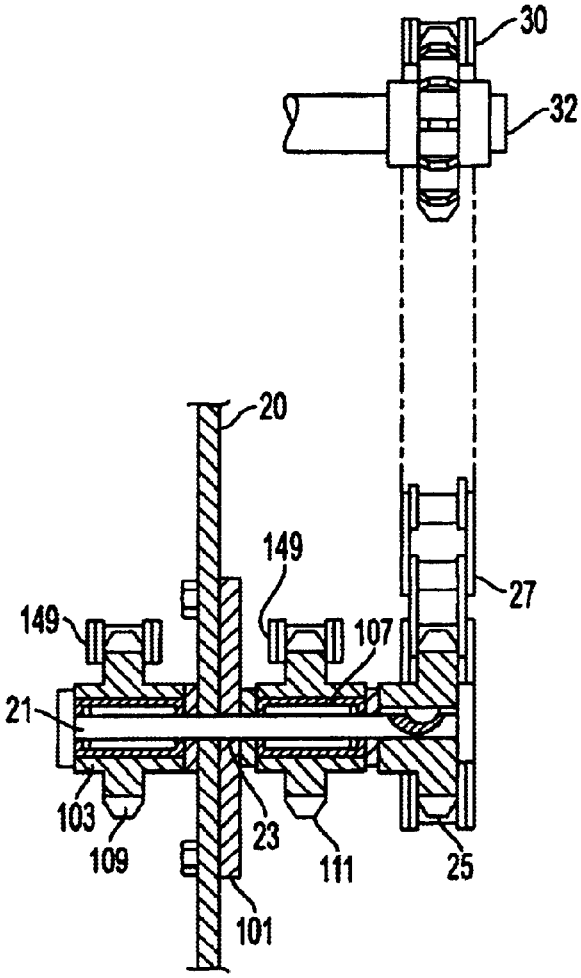
FIG. 6 is a partial cross-sectional view of a portion of the device.

Also coaxially positioned on the drive shaft 21 is a first one-way clutch 103 and a second one-way clutch 107, as best seen in FIG. 6. The end of the drive shaft 21 opposite from the sprocket 25 extends through the second one-way clutch 107, through a bearing member 101, through the mounting bracket 20 and through the first one-way clutch 3. A sprocket 109 is mounted on the first one-way clutch 103 and a sprocket 111 is mounted on the second one-way clutch 107, as will be described in detail below.

Figure 2:
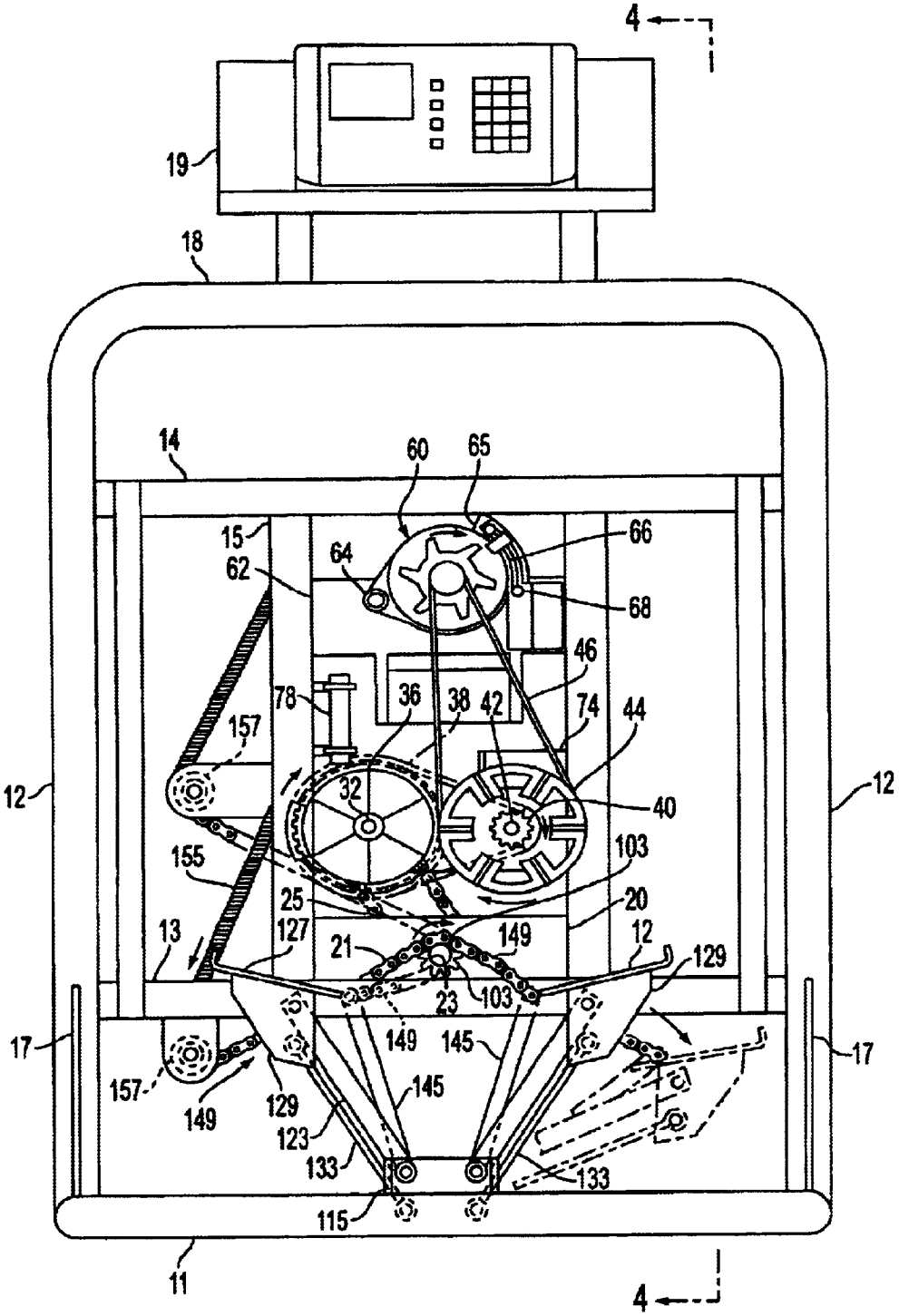
FIG. 2 is a front elevational view, partially in phantom.

Referring again to FIG. 3, the sprocket 30 is operatively connected to a driven shaft 32 which extends through a mounting bracket 34 extending between the vertical brace members 15. The end of the driven 15 shaft 32 that is opposite the sprocket 30 extends through the mounting bracket 34. A driven sprocket 36, as best seen in FIG. 2, is operatively mounted on the end of the driven shaft 32. A drive means 38 such as a belt or other engaging means operatively connects the driven sprocket 36 to a sprocket 40. The sprocket 40 is in a spaced apart relationship to the driven sprocket 36. The sprocket 40 is rotatably mounted on a shaft 42 which extends through the mounting bracket 34. The end of the shaft 42 opposite the sprocket 40 extends through the mounting bracket 34 and a pulley 44 is operatively mounted on the end of the shaft 42. A drive means 46 such as a belt or other engaging means operatively connects the pulley 44 to an alternator 60.

The end of the shaft 42 opposite to the sprocket 40 extends through the mounting bracket 34. An eccentric hub 50 is mounted on the end of the shaft 42 and is secured to the mounting bracket 34 by a plurality of bolts 52. As best seen in FIG. 7, the eccentric hub 50 comprises a flange 54 which defines a plurality of spaced apart openings 58. When the bolts 52 are removed, the hub 50 and its flange 54 are rotated to provide tension to the drive means 38 which connects the sprocket 40 and the driven sprocket 36.

The alternator 60 is pivotally attached to a mounting bracket 62 by a pivot means 64. The alternator 60 includes an extending member 65 which defines an opening or slot 66. A pin 68 extends through the slot 66 and secures the extending member 65 of the alternator 60 to the mounting bracket 62. Tension on the belt 46 is adjusted by loosening the pin 68, pivotally rotating the alternator 60 about the pivot means 64, until there is the desired tension on the drive means 46. The pin 68 is then tightened to secure the alternator 60 in a desired position.

The alternator 60 is operatively connected to a circuit board 70. For ease of illustration, the connecting wires are not shown; however, it should be understood that various configurations of wiring combinations are possible and as such are within the contemplated scope of the invention. The circuit board 70 is operatively connected to the computer display 19 which relays information about the exercise device 5. The circuit board 70 can include one or more suitable members 72 which aid in dissipating heat from the circuit board 70.

The alternator 60 provides resistance to the exercise device 5 when the exercise device is in use, as will be explained in detail below. The alternator 60 is also operatively connected to a battery 74. As the exercise device 5 is in use, as will be explained in detail below, the alternator 60 provides electrical current to the computer display 19, and excess current is directed to the battery 74. When the user first starts the exercise device 5, energy is supplied from the battery 74 to the computer display 19 until such time that the alternator 60 is producing sufficient electrical current to power the computer display 19.

The alternator 60 is also operatively connected to a device 78 such as a heat sink which absorbs or dissipates excess energy as heat when the battery 74 is fully charged.

Figure 1:
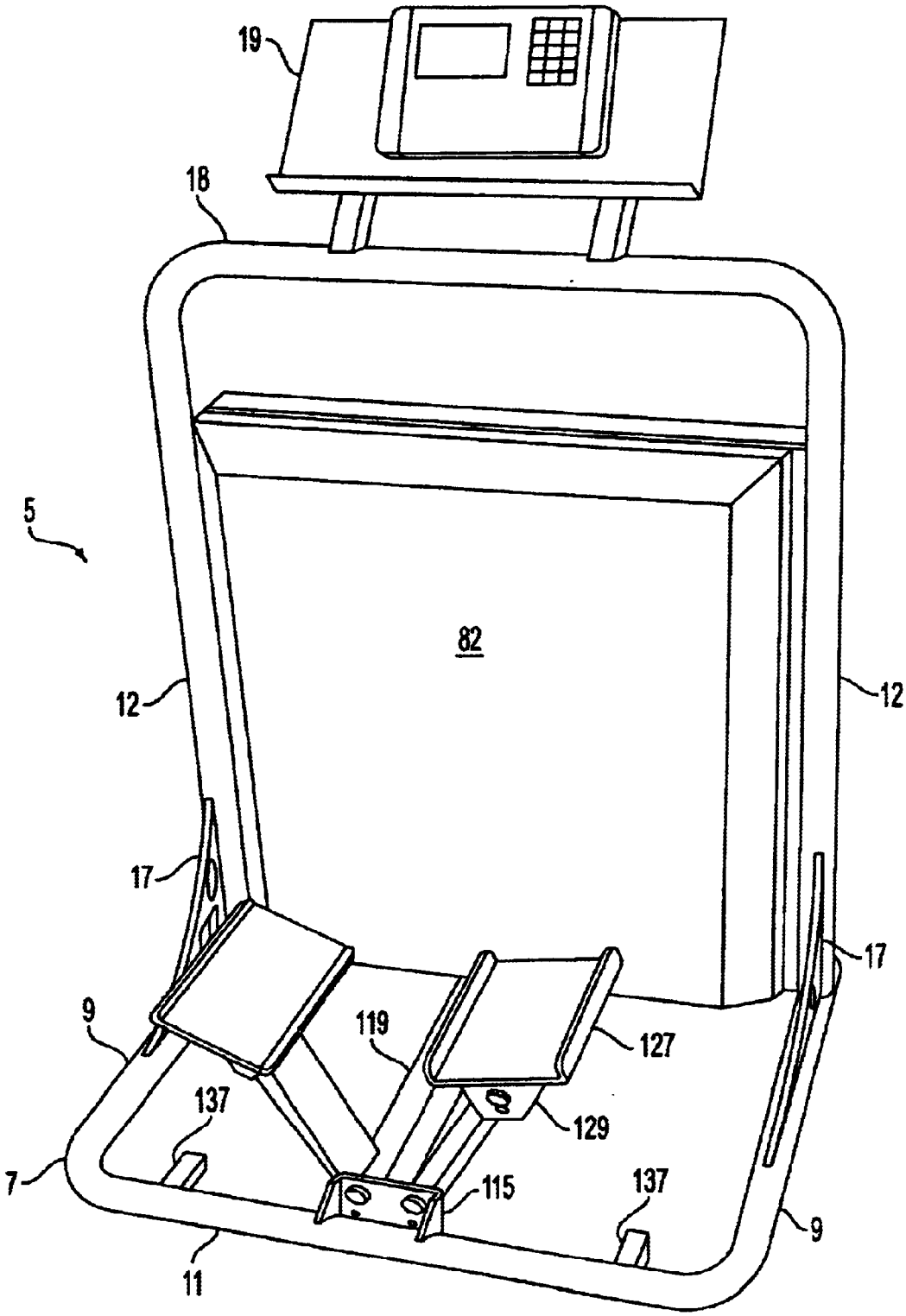
FIG. 1 is a perspective view of the invention.

A pair of vertically extending panel brackets 80 are in a spaced apart parallel relationship and extend from the lower cross member 13 to the upper cross member 14. As seen in FIG. 1, one or more panels 82 are operatively mounted on the panel brackets 80 to protect the user from the various moving members of the exercise device 5.

Referring now in particular to FIGS. 2 and 3, a support flange 115 is secured to the front member 11 of the base 7. A pair of rotatable cylinders 119 extend from the support flange 115 and toward the rear base member 10. The rotatable cylinders 119 are mounted in a manner such that the cylinders 119 are free to rotate around the longitudinal axis of each cylinder. An arm 123 is secured to each rotatable cylinder 119 on the end of the cylinders that is adjacent the support flange 115. A foot pad 127 having a base plate 129 is pivotally secured to the end of each arm 123 that is spaced apart from the rotatable cylinders 119. The foot pads 127 are disposed to move in an arcuate path away from each other in a clockwise and counter-clockwise direction and away from the side members 9 of the base 7. The movement of the foot pads 127 is in a direction that is substantially parallel to the front member 11 of the base 7. The base plate 129 is positioned beneath each foot pad 127. The base plate 129 is secured to the arm 123 in a manner to allow the foot pad 127 to be pivotally mounted on the arm 123. A link member 133 is positioned to extend from the base plate 129 to the front member 11 of the base 7. The link member 133 is pivotally secured to the base plate 129 and to the front member 11. The link member 133 is positioned so that it is not quite parallel to the arm 123. The link member 133 and the arm member 123 cooperate to maintain the foot pad 127 at an angle of about 10° to about 20° with respect to the surface upon which the exercise device 5 is positioned. The link members 133 are disposed to maintain this angular relationship as the foot pads 127 rotate with the arms 123. Positioned on the front member 11 of the base 7 are a pair of stops 137. The stops 137 extend from the front member 11. The stops 137 are disposed on the front member 11 to engage the foot pads 127 to stop further downward rotation of the foot pads 127.

A lever 145 is secured to each rotatable cylinder 119 on the end of the cylinder 119 that is adjacent the rear base member 10. The levers 145 are disposed to extend upwardly from the rotatable cylinders 119 and are disposed at an angle that is substantially the same as the angle at which the arms 123 are positioned on the rotatable cylinders 119. A drive means such as a chain 149 is connected to the end of each lever 145 that is spaced apart from the rotatable cylinders 119. The chain 149 that is connected to one lever 145 extends around the first one-way clutch 103 and the chain 149 that is connected to the other lever arm 145 extends around the second one-way clutch 107. The end of each chain 149 that is spaced apart from the lever 145 is connected to a spring member 155. Each spring member 155 extends from the chain 149 around an idler roll 157. The end of each spring member 155 that is opposite to the end that is connected to the chain 149 is secured to the device by a suitable mechanism such as a hook 159 that is mounted on the support members 14 and/or to an opening 158 in the vertical frame member 15.

One of each chain 149 is positioned on either the first one-way clutch 103 or the second one-way clutch 107 so that the clutches are engaged and cause the drive shaft 21 to rotate when the foot pads 127 are moved in a direction toward the base 7 of the exercise device 5. When the foot pads 127 are moving in a direction away from the base 7, the first one-way clutch 103 and second one-way clutch 107 are not engaged and they can rotate freely and without causing the drive shaft 21 to rotate.

In operation, a person desiring to use the exercise device 5 will position his feet on the foot pads 127 and place his hands on the handle 18. The user will stand in a relatively upright or vertical position on the exercise device 5. To initiate the exercise motion, the user directs a larger portion of his body weight onto one of the foot pads 127 causing the foot pad to rotate on the rotatable cylinder 119 in a direction toward the side members 9 of the base 7. This motion for the foot pad 127 will also cause the lever 145 to rotate in the same direction toward the base 7. As the lever 145 rotates toward the base 7 the chain 149 connected to the lever 145 is also caused to advance in a direction that will cause either the first one-way clutch 103 or the second one-way clutch 107 to be rotated in a direction whereby the one-way clutch engages the drive shaft 21 and causes the drive shaft 21 to be rotated. The advancement of the chain 149 causes the spring member 155 connected to the chain to be elongated. After one foot pad 127 has been caused to move in a direction toward the base 7, the user then positions a substantial portion of his body weight on the other foot pad 127 to cause that foot pad 127 to advance toward the side members 9 of the base 7. As the other foot pad 127 is advanced in a direction toward the base 7, the lever 145 connected to this foot pad through the rotatable cylinder 119 will cause the chain 149 to advance over one of the one-way clutches in a direction that engages a one-way clutch and causes the drive shaft 21 to rotate. As one foot pad 127 is advanced toward the base 7, the opposite foot pad 127 is rotated away from the base 7 by the force of the spring member 155 acting through the chain 149 on the lever 145 connected to the rotatable cylinder 119 on which the foot pad 127 is connected. When the foot pad 127 is advancing away from the base 7, the direction of travel of the chain 149 over the first or second one-way clutch is such that the clutch is not engaged and the clutch free wheels around the drive shaft 21. In this manner, the drive shaft 21 is alternatively driven by the foot pads 127 as they are advanced toward the base 7. However, the return motion of the foot pads 127 away from the base 7 does not engage the one-way clutches and does not cause the drive shaft 21 to rotate. The foot pads 127 can be advanced toward the base 7 until the foot pads engage the stops 137 positioned on the front member 11 of the base 7.

The motion that the user imparts to the foot pads 127 is a sideways motion. That is, the user causes his foot to move in a sideways direction as said foot pads 127 are caused to advance toward the side members 9 of the base 7. The right foot will move to the right and the left foot will move to the left as the user activates the exercise device 5. The motion experienced by the user's feet on the foot pads 127 is substantially perpendicular to the motion experienced by a person's feet when walking or running. The movement of the foot pads 127 is in a direction that is substantially parallel to the front member 11 of the base 7.

Rotation of the drive shaft 21 causes the sprocket 25 to rotate along with the drive shaft 21. Rotation of the sprocket 25 causes the drive means 27 to be advanced in a direction that engages the sprocket that is positioned on the shaft 32. The engagement of the sprocket causes the shaft 32 to rotate which in turn results in the rotation of the driven sprocket 36 that is also secured to the shaft 32. Rotation of the driven sprocket 36 causes the drive means 38 to be advanced in a direction that engages the sprocket 40, which in turn, results in the rotation of the pulley 44 that is also secured to the shaft 42.

Rotation of the pulley 44 causes the drive means 46 to be advanced in a direction that engages the alternator 60. As the drive means 46 continues to be advanced, the alternator 60 provides resistance to the exercise device 5. Increasing or decreasing the resistance to rotation of the alternator 60 also acts to increase or decrease the resistance necessary to move the foot pads 127 in a direction toward the base 7. This allows the exercise device 5 to continue to rotate smoothly if the user of the exercise device 5 stops advancing the foot pads 127.

When the foot pads 127 move through the desired range of motion toward and away from the base 7, the link members 133 act to control the angular position of the foot pads 127. The link members 133 maintain the foot pads 127 at an angle that is substantially about 10° to about 20° throughout the range of motion for the foot pads 127.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense.

I claim:

1. An exercise device comprising:

a base having at least one frame member extending from said base, a drive shaft positioned on said frame;

means for operatively connecting the drive shaft to an alternator;

a pair of arms having a first end that is pivotally mounted on said base and a second end that extends from said base:

a foot pad positioned on the second end of each of said arms; said foot pads being disposed to move in an arcuate path away from each other in a clockwise and counterclockwise direction towards and away from said base;

a lever operatively connected to each arm whereby movement of said arms causes a movement of said levers; and means for operatively connecting one of said levers to a first one-way clutch and for connecting said other lever to a second one-way clutch whereby movement of said arms towards said base causes said levers to rotate said first and second one-way clutches in a direction that causes said drive shaft to rotate, which in turn causes said alternator to provide resistance to movement of said arms and whereby movement of said arms away from said base rotates said levers in a direction that does not activate said first and second one-way clutches and does not cause said drive shaft to rotate;

wherein said means for operatively connecting said first drive shaft to said alternator comprises a first sprocket mounted on said first drive shaft and operatively connected to a second sprocket mounted on a second shaft; a third sprocket operatively mounted on said second shaft and operatively connected to a fourth sprocket operatively mounted on a third shaft; and a pulley operatively mounted on said third shaft and operatively connected to said alternator.

2. The device of claim 1, wherein said pulley has at least one groove in its outer periphery and a tension belt is positioned in said groove, said belt being moveable to vary the tension on said pulley whereby said resistance to rotation of said alternator can be varied which varies the resistance of movement for said foot pads and levers.

3. The device of claim 1, wherein said alternator is pivotally mounted to said frame for allowing adjustment of tension between said alternator and said pulley.

4. The device of claim 1, wherein an eccentric hub is operatively mounted on one end said third shaft for allowing adjustment of tension between said fourth sprocket and said third sprocket.

5. An exercise device comprising:

a base having at least one frame member extending from said base;

a drive shaft positioned on said frame;

means for operatively connecting the drive shaft to an alternator;

a pair of arms having a first end that is pivotally mounted on said base and a second end that extends from said base:

a foot pad positioned on the second end of each of said arms; said foot pads being disposed to move in an arcuate path away from each other in a clockwise and counterclockwise direction towards and away from said base;

a lever operatively connected to each arm whereby movement of said arms causes a movement of said levers:

means for operatively connecting one of said levers to a first one-way clutch and for connecting said other lever to a second one-way clutch whereby movement of said arms towards said base causes said levers to rotate said first and second one-way clutches in a direction that causes said drive shaft to rotate, which in turn causes said alternator to provide resistance to movement of said arms and whereby movement of said arms away from said base rotates said levers in a direction that does not activate said first and second one-way clutches and does not cause said drive shaft to rotate; and a pair of rotatable cylinders operatively connected to said base, one of said arms and one of said levers being secured to one of said rotatable cylinders whereby movement of said foot pads causes said cylinders to rotate.

6. The device of claim 5, wherein said levers have a first end connected to one of said rotatable cylinders and a second end that extends from said rotatable cylinder, said levers being positioned in adjacent spaced apart relationship to said frame.

7. The device of claim 5, wherein a base plate is pivotally mounted on said second end of said arm and said foot pad is secured to said base plate.

8. An exercise device comprising:

a base having at least one frame member extending from said base;

a drive shaft positioned on said frame;

means for operatively connecting the drive shaft to an alternator:

a pair of arms having a first end that is pivotally mounted on said base and a second end that extends from said base;

a foot pad positioned on the second end of each of said arms, said foot pads being disposed to move in an arcuate path away from each other in a clockwise and counterclockwise direction towards and away from said base;

a lever operatively connected to each arm whereby movement of said arms causes a movement of said levers;

means for operatively connecting one of said levers to a first one-way clutch and for connecting said other lever to a second one-way clutch whereby movement of said arms towards said base causes said levers to rotate said first and second one-way clutches in a direction that causes said drive shaft to rotate, which in turn causes said alternator to provide resistance to movement of said arms and whereby movement of said arms away from said base rotates said levers in a direction that does not activate said first and second one-way clutches and does not cause said drive shaft to rotate;

a base plate is pivotally mounted on said second end of said arm and said foot pad is secured to said base plate; and a link member positioned to extend from said base plate to a front member of said base, said link member being pivotally secured to said front member and said foot pad, said link member acting to maintain said foot pad at a desired angle as said foot pad travels through its range of motion on said arm.

9. The device of claim 8, wherein said one-way clutches are mounted on said drive shaft and said means for operatively connecting said drive shaft to said alternator connects to said one-way clutches whereby said one-way clutches cause said drive shaft to rotate in only one direction.

10. The device of claim 8, wherein said means for operatively connecting said levers to said first and second one-way clutches comprise chains, each chain having a first end and a second end, the first end of said chain being connected to said lever, each of said chains extending over said one-way clutch and said second end of said chain being operatively connected to said frame.

11. The device of claim 10, wherein said second end of said chain is connected to the first end of a spring and said second end of said spring is connected to said frame, whereby said spring expands and retracts as said chain advances over said one-way clutch.

12. The device of claim 8, wherein said desired angle is from about 10° to about 20° with respect to the surface upon which said exercise device is positioned.

13. The device of claim 8, wherein a handle is positioned on a portion of said frame that is spaced apart from said base, said handle providing a balancing for a user of said device.

14. The device of claim 8, wherein said alternator is operatively connected to a device for absorbing or dissipating unwanted energy.

15. An exercise device comprising:

a base having at least one frame member extending from said base;

a drive shaft positioned on said frame;

means for operatively connecting the drive shaft to an alternator;

a pair of arms having a first end that is pivotally mounted on said base and a second end that extends from said base;

a foot pad positioned on the second end of each of said arms: said foot pads being disposed to move in an arcuate path away from each other in a clockwise and counterclockwise direction towards and away from said base;

a lever operatively connected to each arm whereby movement of said arms causes a movement of said levers; and means for operatively connecting one of said levers to a first one-way clutch and for connecting said other lever to a second one-way clutch whereby movement of said arms towards said base causes said levers to rotate said first and second one-way clutches in a direction that causes said drive shaft to rotate, which in turn causes said alternator to provide resistance to movement of said arms and whereby movement of said arms away from said base rotates said levers in a direction that does not activate said first and second one-way clutches and does not cause said drive shaft to rotate;

wherein said alternator is operatively connected to a battery.

16. The device of claim 15, wherein said battery stores electrical energy generated by said alternator and provides energy to a computer display operatively connected to said device.

* * * * *